US009957145B2

(12) United States Patent
Cohen et al.

(10) Patent No.: US 9,957,145 B2
(45) Date of Patent: May 1, 2018

(54) DOSING SYSTEM

(71) Applicant: SodaStream Industries Ltd.

(72) Inventors: Avi Cohen, Jerusalem (IL); Zvi Ben Shalom, Bat Hadar (IL)

(73) Assignee: SodaStream Industries Ltd., Maale Gilboa (IL)

( * ) Notice: Subject to any disclaimer, the term of this patent is extended or adjusted under 35 U.S.C. 154(b) by 0 days. days.

(21) Appl. No.: 15/058,179

(22) Filed: Mar. 2, 2016

(65) Prior Publication Data

US 2016/0257551 A1 Sep. 8, 2016

Related U.S. Application Data

(60) Provisional application No. 62/127,848, filed on Mar. 4, 2015, provisional application No. 62/127,853, filed on Mar. 4, 2015.

(51) Int. Cl.

| | |
|---|---|
| ***B67D 1/00*** | (2006.01) |
| ***B67D 1/08*** | (2006.01) |
| ***B67D 1/10*** | (2006.01) |

(52) U.S. Cl.

CPC ..... *B67D 1/0037* (2013.01); *B67D 1/0022* (2013.01); *B67D 1/0034* (2013.01); *B67D 1/0057* (2013.01); *B67D 1/0058* (2013.01); *B67D 1/0085* (2013.01); *B67D 1/0888* (2013.01); *B67D 1/108* (2013.01); *B67D 2001/0827* (2013.01); *B67D 2210/0016* (2013.01); *B67D 2210/00146* (2013.01)

(58) Field of Classification Search

CPC .. B67D 1/0022; B67D 1/0034; B67D 1/0037; B67D 1/0057; B67D 1/0058; B67D 1/0085; B67D 1/0888; B67D 1/108; B67D 2001/0827; B67D 2210/00146; B67D 2210/0016

See application file for complete search history.

(56) References Cited

U.S. PATENT DOCUMENTS

| | | | | |
|---|---|---|---|---|
| 5,614,411 A * | 3/1997 | Gastgaber | A47K 11/035 | 210/206 |
| 6,386,403 B2 * | 5/2002 | Parsons | B67D 7/0238 | 222/181.3 |
| 2003/0145734 A1 * | 8/2003 | Ervin | A23G 9/045 | 99/275 |
| 2006/0171091 A1 * | 8/2006 | Seale | F01L 9/04 | 361/160 |

(Continued)

FOREIGN PATENT DOCUMENTS

| | | | |
|---|---|---|---|
| GB | 2379719 | 3/2003 | |
| GB | 2379719 A * | 3/2003 | F04B 43/107 |
| WO | WO 2013182340 A1 * | 12/2013 | A47J 31/467 |

OTHER PUBLICATIONS

International Search Report for corresponding PCT application PCT/IB2016/051155 dated Jul. 24, 2016.

*Primary Examiner* — Paul R Durand
*Assistant Examiner* — Bob Zadeh
(74) *Attorney, Agent, or Firm* — Pearl Cohen Zedek Latzer Baratz LLP

(57) ABSTRACT

A dosing system including a dispensing tube to dispense a viscous liquid from a holding container to an output container, the tube includes an upper and a lower valve and a peristaltic pump to push against the dispensing tube and to cause the viscous liquid to open the lower valve.

13 Claims, 7 Drawing Sheets

(56) References Cited

U.S. PATENT DOCUMENTS

| | | | | |
|---|---|---|---|---|
| 2007/0151984 | A1* | 7/2007 | Baker | A61J 1/2089 222/129 |
| 2009/0069934 | A1* | 3/2009 | Newman | B67D 1/0021 700/239 |
| 2009/0069949 | A1* | 3/2009 | Carpenter | B67D 1/0021 700/283 |
| 2010/0005903 | A1* | 1/2010 | Beavis | B67D 1/0036 73/861.47 |
| 2012/0018448 | A1* | 1/2012 | Mehus | A47L 15/0055 222/63 |
| 2013/0304265 | A1* | 11/2013 | Deo | B67D 1/0027 700/283 |
| 2014/0294610 | A1 | 10/2014 | Labarthe et al. | |
| 2015/0024088 | A1 | 1/2015 | Cohen et al. | |
| 2015/0102062 | A1* | 4/2015 | Mosimann | B67D 1/0022 222/129.1 |
| 2016/0257551 | A1* | 9/2016 | Cohen | B67D 1/0022 |

* cited by examiner

DOSING SYSTEM

CROSS-REFERENCE TO RELATED APPLICATIONS

This application claims priority from U.S. provisional patent applications 62/127,848, filed Mar. 4, 2015, and 62/127,853, filed Mar. 4, 2015, both of which are incorporated herein by reference.

FIELD OF THE INVENTION

The present invention relates to dosing systems generally and the dosing of viscous liquids in particularly.

BACKGROUND OF THE INVENTION

Viscous liquids such as drink concentrate and syrups often need to be measured out fairly precisely, too much concentrate may make a drink too strong and too little, too weak. Often it is hard to ascertain exactly how much syrup needs to be added due to the different viscosities. The ideal amount for one flavor may not be so optimal for another. Also it is often difficult to assess how much syrup has been dispensed especially when a bottle or container is almost empty and the last drops are being shaken out. If a bottle containing syrup is shaken too hard, too much syrup is released etc.

The manual addition of these syrups may also be messy especially when adding them to a vessel with a small opening such as the addition of syrup to a bottle of carbonated water. Particularly viscous syrups may not just flow though the mouth of the bottle but also down the sides.

SUMMARY OF THE PRESENT INVENTION

There is provided, in accordance with a preferred embodiment of the present invention, dosing system including a dispensing tube to dispense a viscous liquid from a holding container to an output container, the tube comprising an upper and a lower valve; and a peristaltic pump to push against the dispensing tube and to cause the viscous liquid to open the lower valve.

Moreover, in accordance with a preferred embodiment of the present invention, the dosing system also includes a Hall Effect sensor to measure the strength of a front sensor magnet of the pump and to determine the presence of the dispensing tube.

Further, in accordance with a preferred embodiment of the present invention, the system also includes an RFID reader to read information stored on an RFID tag attached to the holding container, a database to store pre-determined schedules based on the information; and a controller to instruct the pump to pump the syrup from the holding container according to the pre-determined schedules.

Still further, in accordance with a preferred embodiment of the present invention, the information is at least one of: attributes of the syrup and the amount of the selected syrup previously dispensed from the holding container.

Additionally, in accordance with a preferred embodiment of the present invention, the tag is at least one of: read and read/write capable.

Moreover, in accordance with a preferred embodiment of the present invention, the dispensing tube includes threads to connect to the holding container via a threaded spout.

Further, in accordance with a preferred embodiment of the present invention, the system includes an RFID writer to write the information onto the RFID tag.

There is provided, in accordance with a preferred embodiment of the present invention, a home system for producing flavored carbonated drinks. The system includes a carbonation system to carbonate water according to a desired level of carbonation, a syrup holder to hold at least at least one syrup container, a pumping system, one per the at least one syrup container, to pump syrup according to a pre-determined schedule and a drink dispenser to dispense the carbonated water and the syrup into a drinking vessel, a controller to receive a desired level of carbonation and a selected syrup from the at least one syrup container and to coordinate between the carbonation system, the pumping system and the drink dispenser to dispense a drink according to the level of carbonation and the selected syrup.

Further, in accordance with a preferred embodiment of the present invention, the system also includes a syrup dispensing tube, one per the at least one syrup container, attached to the at least one syrup container via a threaded spout to dispense the syrup into the drinking vessel, the syrup dispensing tube having an upper and a lower valve and a water dispensing tube to dispense at least one of carbonated water and non-carbonated water into the drinking vessel.

Still further, in accordance with a preferred embodiment of the present invention, the system also includes an RFID reader to read information stored on an RFID tag attached to the syrup container and a database to store the pre-determined schedules based on the information.

Additionally, in accordance with a preferred embodiment of the present invention, the tag is at least one of read and read/write capable.

Moreover, in accordance with a preferred embodiment of the present invention, the pumping system includes a peristaltic pump to push against the syrup dispensing tube and to cause the viscous liquid to open the lower valve and a hall effect sensor to measure the strength of a front sensor magnet of the pump and to determine the presence of the dispensing tube.

Further, in accordance with a preferred embodiment of the present invention, the drink dispenser comprises a tube holder tray having multiple holes to position a plurality of the syrup dispensing tubes and the water dispensing tube to ensure direct dispensing into the drinking vessel.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
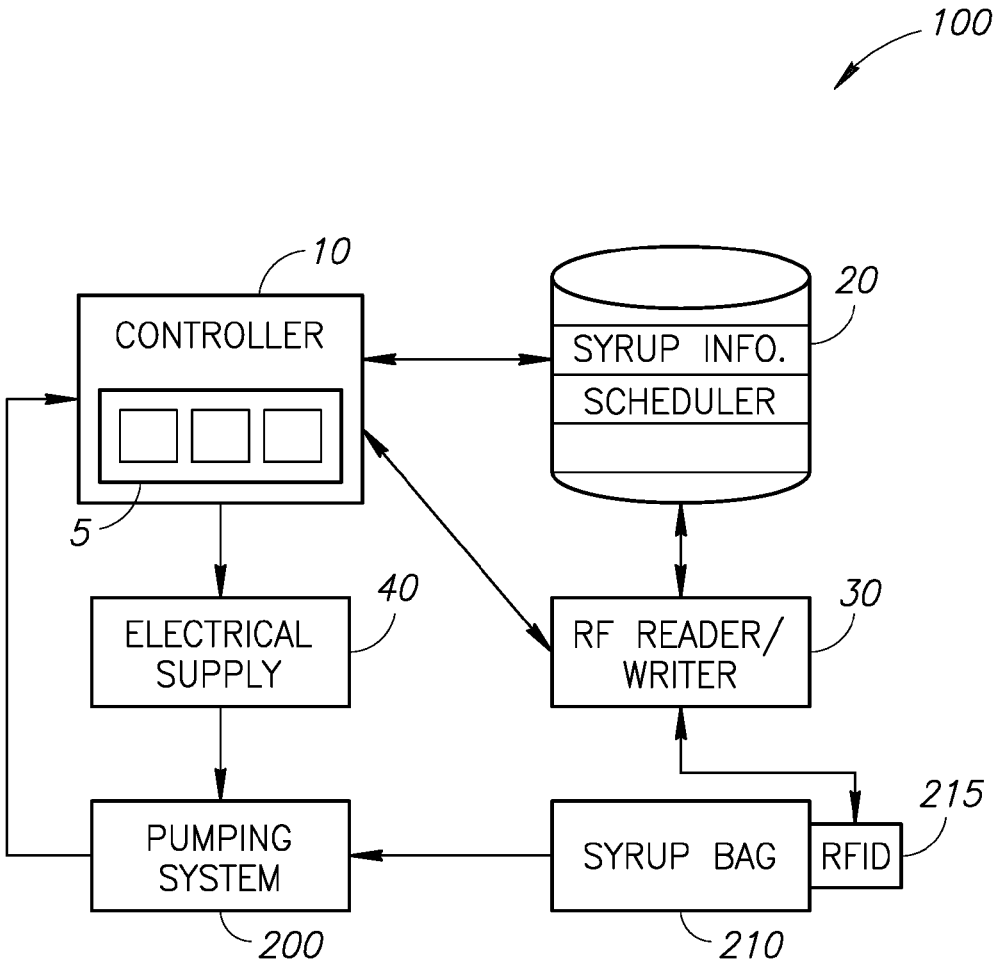
FIG. 1 is a schematic illustration of a dosing system, constructed and operative in accordance with the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Applicants have realized that syrups and other viscous liquids may be dispensed more efficiently if the dosing is automated and controlled according to the viscosity of the syrup, the amount desired etc.

Applicants have also realized that this may be achieved by an automated dosing system that includes the ability to understand the content to be dispensed and to dispense it according to pre-defined schedules. Applicants have further realized that this may be done by first understanding various details about the syrup to be dispensed (viscosity etc.) which may be read, for example by a RF reader/writer from an RFID tag associated with a container holding the syrup and also by understanding any user specifications like the strength of syrup required according to user input. Once the system knows what and how to dispense, it may create a piston type effect using an electromagnetic field. The piston may strike against a purposely designed dispensing tube comprising 2 one way valves, thus turning the dispensing tube into a form of peristaltic pump. It will be appreciated that the rate and speed of the piston may be controlled according to a suitable pumping schedule based on the above mentioned characteristics. When the tube is squeezed, it may release content, when it is in a rest position, no syrup is released.

Reference is now made to FIG. 1 which illustrates a dosing system 100 according to an embodiment of the current invention. System 100 comprises a controller 10, a database 20, a RF reader/writer 30, an electrical supply 40, a syrup bag 210 and a pumping system 200. Controller 10 may further compromise a control panel 5. Syrup bag 210 may further comprise an RFID tag 215. It will be appreciated that system 100 may be used as part of a home carbonation system that has the ability to prepare flavored carbonated drinks including the ability to dispense different flavors of syrups as discussed in more detail herein below.

It will also be appreciated that although system 100 is discussed in relation to syrups for making drinks, it may be used to dispense other viscous liquids such as medicines. It will be further appreciated that syrup bag 210 may be any holding container suitably designed to hold the pertinent viscous liquid.

A user may place a request for a drink via control panel 5 which may be any purpose built interface in order to select the desired syrup and concentration. It will be appreciated that control panel 5 may also comprise an interface for data entry and the preprogramming of schedules etc. as described in more detail herein below.

Controller 10 may receive the pertinent input (which syrup and what concentration) and may instruct RF reader/writer 30 to read RFID tag 215 of the appropriate syrup bag 210. It will be appreciated that controller 10 may be aware of the syrup bags 210 in place and control panel 5 may display the options accordingly. I.e. if the syrups in place are cola, lemonade and ginger ale, control panel 5 may not offer an option for a grapefruit flavored drink.

RF reader/writer 30 may read from RFID tag 215 characteristics pertaining to the syrup in syrup bag 210 such as expiry date, manufacturing information, viscosity etc.

It will also be appreciated controller 10 may keep track of the amount of syrup dispensed each time (as described herein below) and may therefore know the amount of syrup remaining in syrup bag 210 at any one time. If syrup bag 210 is removed from system 100 (as described in more detail herein below) and repositioned at a later stage, controller 10 may also recognize and remember syrup bag 210 through a suitable identifier and thus know the amount of syrup remaining. In an alternative embodiment, RF reader/writer 30 may write to RFID tag 215 the amount of syrup that is dispensed each time or the amount of syrup left in the bag, which may be read by RF reader/writer 30 at a later stage. Thus RF reader/writer 30 may also instruct controller 10 to present via control panel 5 a warning sign that the syrup bag 210 requires changing when there is not enough syrup left to create a drink.

Controller 10 may use the input information from control panel 5 (such as desired strength of drink) and the identifying information from RF reader/writer 30 in order to access a dosing schedule from database 20. It will be appreciated that dosing schedules may be pre-determined by a user and/or manufacturer according to syrup characteristics and desired strength of drink and system 100 may be preprogrammed via a suitable interface on control panel 5. For example, for a very weak drink from particularly viscous syrup, the pumping schedule may state that only 2 drops need to be dispensed as opposed to 8 drops needed for a stronger drink. Once controller 10 has retrieved an appropriate dosing schedule, it may instruct electrical supply 40 to supply pumping system 200 with an electric current accordingly.

Figure 2:
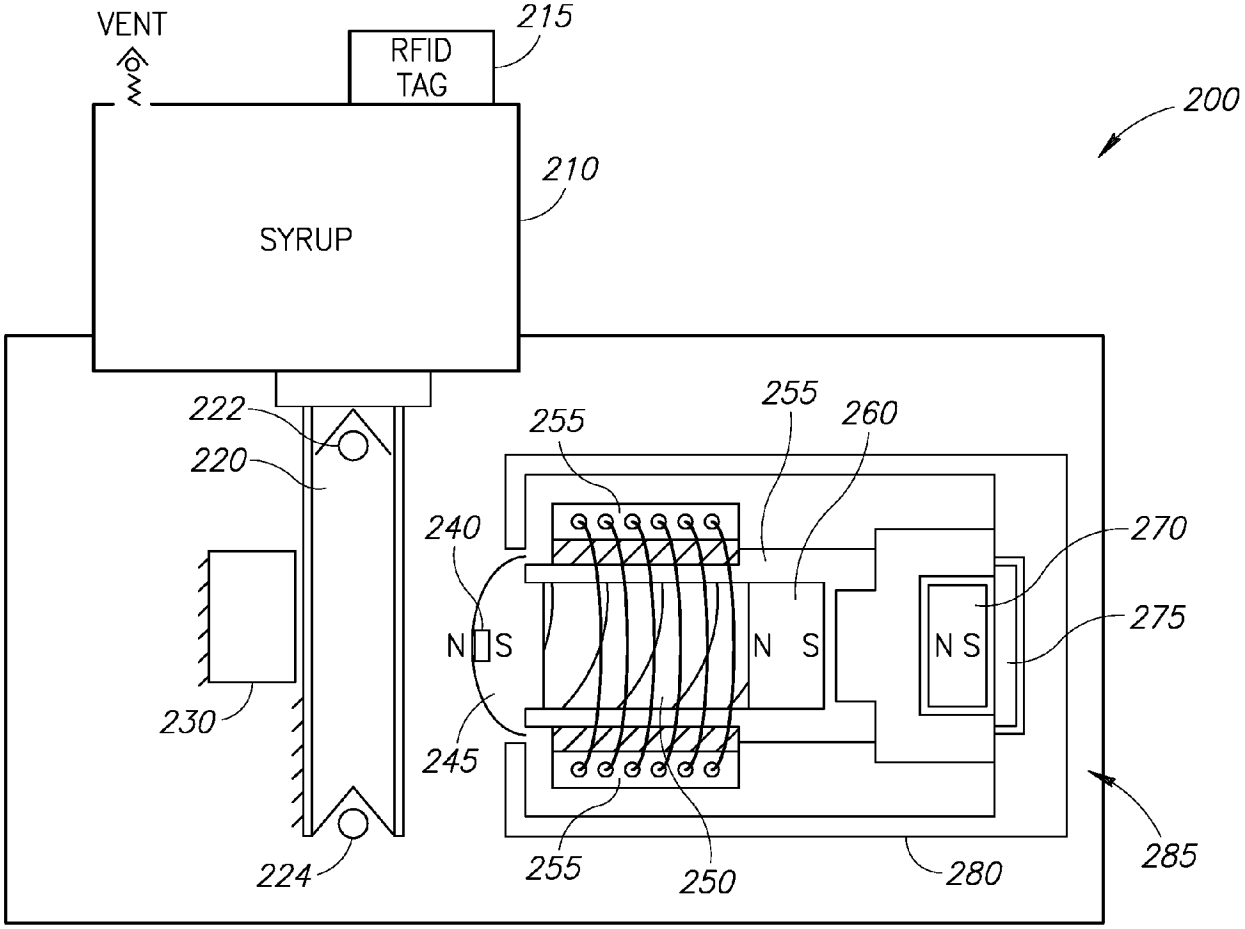
FIG. 2 is a schematic illustration of the pumping system of FIG. 1, constructed and operative in accordance with the present invention.

Reference is now made to FIG. 2 which illustrates a pumping system 200 in accordance with an embodiment of the present invention. System 200 comprises a dispensing tube 220 that may be connected to syrup bag 210, a Hall Effect sensor 230 and a solenoid 285. Dispensing tube 220 may further comprise an upper valve 222 and a lower valve 224. Solenoid 285 may further comprise a front sensor magnet 240, a piston cap 245, a ferromagnetic metal core 250, a bobbin coil 255, an internal permanent magnet 260 a rear magnet 270, a back damper 275 and a magnetic shield 280.

It will be appreciated that dispensing tube 220 may be placed between sensor 230 and solenoid 285. When an electric current (from electrical supply 40) is passed through bobbin coil 255, it may create an electromagnetic field due to the presence of ferromagnetic metal core 250. It will be also appreciated that the creation of the electromagnetic field may cause ferromagnetic metal core 250 to overcome the magnetic force between magnet 260 and rear magnet 270 and move towards dispensing tube 220. It will be further appreciated that since ferromagnetic metal core 250 may be connected to both piston cap 245 and magnet 260, they may also move together with ferromagnetic metal core 250 towards dispensing tube 220.

When the electric current is stopped, ferromagnetic metal core 250 (together with piston cap 245 and magnet 260) may be pulled back to its rest point due to the reverse electrical signal and the attraction between magnet 260 and rear magnetic 270.

Thus the control of the electric current may cause ferromagnetic metal core 250 (together with piston cap 245 and magnet 260) to move backwards and forwards in a pulsating type movement (pulse width modulation). Piston cap 245 may pummel against dispensing tube 220 accordingly. It will be further appreciated that the amount of pressure applied to dispensing tube 220 by piston cap 245 may be controlled by alternating the frequency and pulse width of the electrical supply to solenoid 280 according to the above mentioned dosing schedules. A typical frequency may be in the range 1-30 Hz with pulse width from 10% to 80%.

Damper 275 may ensure that ferromagnetic metal core 250 (together with piston cap 245 and magnet 260) remain in their optimal position at rest and magnetic shield 280 may stop any electrical magnetic field created from escaping from within the confines of solenoid 285.

It will be appreciated that sensor 230 may gauge the strength of the magnetic field created by magnet 240. Therefore when dispensing tube 220 is missing, sensor 230 may be in the direct line of front sensor magnet 240 without any form interference. Sensor 230 may release an electrical signal to controller 10. Controller 10 may receive the electric signal and instruct electrical supply 40 to stop supplying any further current to solenoid 285 in order to stop the process.

Figure 3:
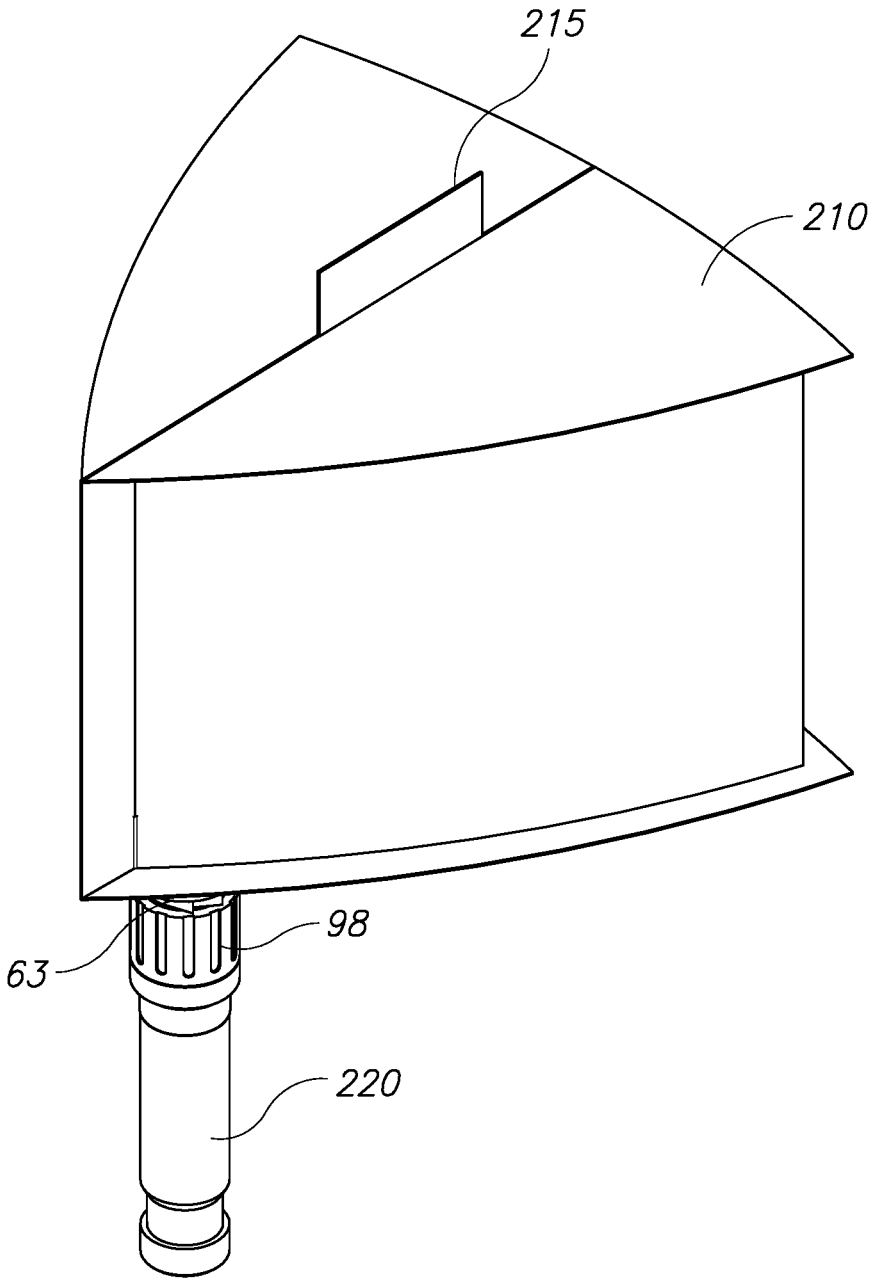
FIG. 3 is a schematic illustration of a syrup bag and a dispensing tube, constructed and operative in accordance with the present invention.

As discussed herein above, dispensing tube 220 may comprise 2 one way valves 222 and 224. Dispensing tube 220 may be manufactured from silicone or similar flexible food grade material and may be attached to syrup bag 210 as is illustrated in FIG. 3 to which reference is now made. Each syrup bag 210 may comprise an opening 63 from which syrup may be dispensed. Dispensing tube 220 may be threaded and connected to opening 63 via a threaded spout 98.

It will be appreciated that the first time dispensing tube 220 is used, both valves 222 and 224 may be closed and dispensing tube 220 may be empty. It will also be appreciated that sensor 230 may also determine when dispensing tube 220 is present but empty. As described herein above, sensor 230 may still sense front sensor magnet 240 (although the magnetic field may be significantly weaker due to the presence of dispensing tube 220) and it may inform controller 10 accordingly.

Figure 4A:
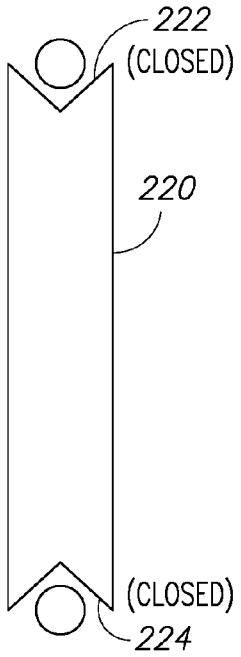
FIGS. 4A, 4B, 4C and 4D and are schematic illustrations of the different states of the dispensing tube of FIG. 3, constructed and operative in accordance with the present invention.
Figure 4B:
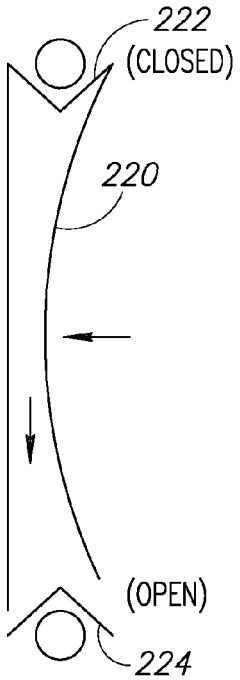
Figure 4C:
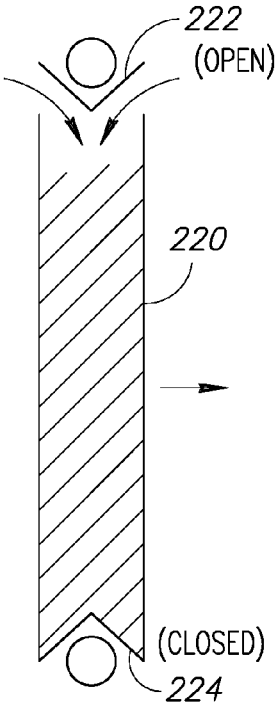

As discussed herein above, the movement of piston cap 245 against dispensing tube 220 may cause dispensing tube 220 to act as a peristaltic pump as is illustrated in FIGS. 4A, 4B, 4C and 4D to which reference is now made. As discussed herein above, dispensing tube 220 when used for the first time, may be empty as is illustrated in FIG. 4A. When dispensing tube 220 is in its initial rest position, both valves 222 and 224 may be closed. When solenoid 285 is activated, the pressure of piston cap 245 against dispensing tube 220 may press against the side of dispensing tube 220 squeezing it inwards, the resulting internal pressure of which may push downwards causing lower valve 224 to open as is illustrated in FIG. 4B. Valve 222 is therefore forced to remain closed. When piston cap 245 is released and the pressure against tube 220 is released, the indented wall of tube 220 may return to its rest position while creating a vacuum within tube 220. The resulting vacuum build up may cause valve 222 to open and valve 224 to close. It will be appreciated that the opening of valve 222 may allow syrup to flow into tube 220 from syrup bag 210. It will be appreciated that in this scenario, syrup cannot flow out through valve 224 which has now closed and thus may remain in tube 220. Therefore when tube 220 is in its rest position, it may no longer be empty and may contain an amount of syrup as is illustrated in FIG. 4C.

Figure 4D:
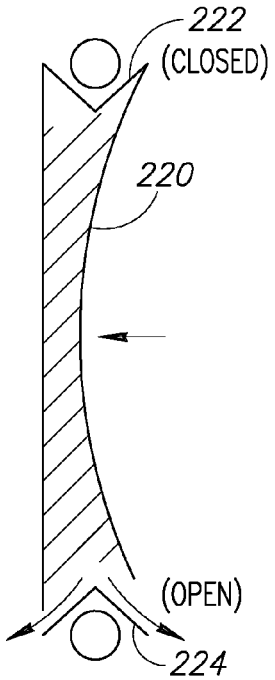

Thus the next time piston cap 245 moves against tube 220, the pressure may cause valve 222 to close and valve 224 to open, releasing the syrup that is sitting within tube 220 as is illustrated in FIG. 4D. The process may thus continue until the determined amount of syrup has been dispensed accordingly.

It will be appreciated that a typical dispense rate may be 0.5-3 cc/s dependent on the frequency and duty cycle of the actuating current and the physical dimensions of dispensing tube 220. A preferred dimension for dispensing tube 220 may be an outer diameter of 8 mm and a length of 30 mm.

Thus the use of a solenoid may turn a flexible dispensing tube into a peristaltic pump in order to dispense it contents. Furthermore, the electrical supply to the solenoid may be based on a dosing schedule further based on knowledge of the characteristics pertaining to the contents to be dispensed.

It will be appreciated that syrup bag 210 may be typically manufactured from PET plastic with or without a barrier layer for oxygen or aluminum. It may also be made with plastic which can be blow molded.

There are many home carbonation systems on the market that allow a user to carbonate water by adding carbon dioxide by pulsing it into to a purposely designed bottle of water. Typical systems provide carbonation in the range of 3-4 g of carbon dioxide per liter of water.

Users desiring different levels of carbonation typically carbonate their water by randomly pulsing carbon dioxide into the bottle accordingly. Patent Publication US 2015/0024088 published 22 Jan. 2015 and assigned to the common assignee of the present invention, describes a different form of home carbonation system that produces different levels of carbonation on demand. Carbon dioxide is added to water in a mixing chamber and the combination is mixed until the desired level of carbonation is produced Home carbonation systems are particularly useful for carbonated drink lovers who can prepare carbonated drinks at home instead of carry home heavy bottles of drink from the shops. They are also a perfect alternative to providing freshly made fizzy drinks on demand. One of the reasons that these systems are so popular is due to the myriad of flavorings that can be purchased to go with these systems, such as pomegranate and bitter orange that exceed the range available with pre-bottled drinks.

Applicants have also realized that manually adding flavored syrup to pre-carbonated water from a bottle of syrup may not always produce the level of concentration desired. The resulting drink maybe too strong or too weak. Applicants have also realized that due to the different viscosities of the various syrups, the optimal amount of one type of syrup for a drink may not be the optimal amount of another type.

Applicants have further realized that adding flavored syrup to pre-carbonated water creates a lot of effervescence. The amount of effervescence may be dependent on the amount of syrup added, the viscosity of the syrup, the level of carbonation of the water and the angle at which the syrup is poured into the carbonated water. If too much effervescence is created the process may be sticky and messy. Users have also been known to create carbonated drinks using a home soda machine by attempting to carbonate regular non-carbonated drinks such as orange juice and wine. It will be appreciated that this may produce a lot of sticky effervescence during the actual carbonation process that may stick to and enter parts of the home carbonation machine which may cause parts to stick and which may be lead to potential malfunctions of the home carbonation machine in question. Furthermore, the use of syrups that come in bottles may be susceptible to spillages, especially when trying to pour a measure into a small lid for addition to the carbonated water or when pouring into a small surface area such as the mouth of a bottle. These syrups may also be very sticky.

It will be appreciated that system 100 as described herein above, may be used with such a home carbonation system that may include the ability to dispense syrup together with carbonated water into a cup in order to create a carbonated drink and may also overcome the above mentioned limitations. The home carbonation system may be further designed to hold more than one syrup bag 210 and therefore may also allow for more than one type of syrup to be dispensed by the system on demand. For example, it may allow a user to prepare a carbonated drink with cola flavoring, lemonade and ginger ale. The home carbonation system may also include a suitable interface that may allow a user to choose the flavor desired, the level of carbonation as well as the level of concentration of his drink. In an alternative embodiment, dosing system 100 may also be used with a drinks system that creates non-carbonated drinks by mixing flavored syrups with water.

As discussed herein above, each syrup bag 210 may have its own associated RFID tag 215 and dispensing tube 220. It will be also appreciated that such an associated dispensing tube 220 may prevent the cross contamination of different flavors dispensed through the same dispensing tube as occurs in typical drinks vending machines as discussed in more detail herein below.

Figure 5:
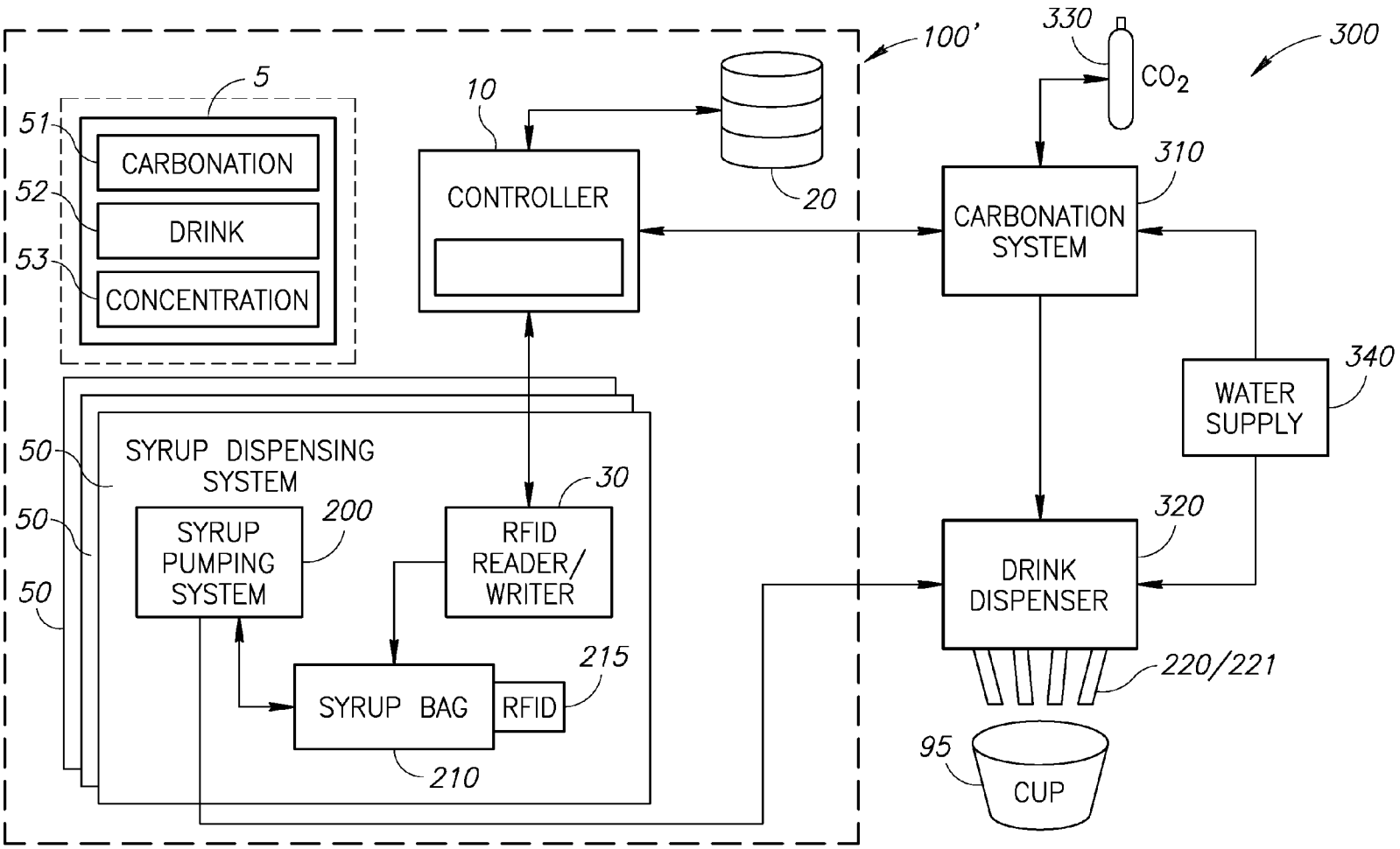
FIG. 5 is a schematic illustration of a home flavored carbonated drinks dispensing system; constructed and operative in accordance with the present invention.

Reference is now made to FIG. 5 which illustrates a system 300 for a home carbonated drinks dispensing system. System 300 may comprise dosing system 100', a carbonation system 310 and a drink dispenser 320. It will be appreciated that dosing system 100' may have similar functionality to system 100 as described herein above. It will be further appreciated that dosing system 100' may comprise more than one syrup pumping system 50. Each syrup pumping system 50 may comprise a syrup pumping system 200, a syrup bag 210 and an RFID reader/writer 30 i.e. there may be a separate syrup dispensing system for each syrup bag 210 held within system 300 as described in more detail herein below.

It will also be appreciated that in this embodiment, controller 10 may further comprise a control panel 5 which may further comprise an input interface such as buttons for desired level of carbonation 51, desired syrup flavor 52 and desired concentration of drink 53.

It will be appreciated that system 300 may offer more than one level of carbonation—strong, weak etc., more than one flavor syrup such as cola, ginger ale and lemonade and may also offer an option for the desired strength of drink. It will be further appreciated that all the parameters required to create the end desired drink may be pre-programmed and stored on database 20 such as the amount of syrup to dispense and the carbonation time as described in more detail herein below. Therefore when a user makes a request for a drink such as a weakly carbonated strong cola, controller 10 may receive the input, lookup the correct parameters from database 20 and instruct the elements of system 300 to produce and dispense the desired drink accordingly. In an alternative embodiment, control panel 5 may also offer options for regular non-carbonated hot water and cold water.

It will be appreciated that controller 10 may also be a smart unit and may remember how a particular user may like his drink which it may recreate after recognizing the user via an appropriate identifier such as name. In this scenario, control panel 5 may comprise a suitable interface. The user details and the drink requirements may be stored on database 20 for later access.

Once controller 10 has determined the correct parameters for the drink to dispense, it may instruct carbonation system 310 to prepare carbonated water at the desired level. It will be appreciated that carbonated system 310 may be any system that may produce different levels of carbonated water on demand together with a controllable parameter for doing this. One such system may be that as described in US Patent Publication US 2015/0024088 published 22 Jan. 2015 and assigned to the common assignee of the present invention. Carbonation system 310 may receive carbon dioxide from gas cylinder 330 and water from water supply 340. It will be appreciated that when such a system is in use, carbonation system 310 may produce carbonated water at the desired level of carbonation by running its water circulation pump for the length of time as defined by controller 10 according to the pre-defined parameters in database 20. Carbonation system 310 may dispense carbonated water into a cup 95 or any output container via drink dispenser 320 and dispensing tubes 221 as described in more detail herein below.

It will be appreciated that in parallel to the production of carbonated water, controller 10 may instruct the relevant syrup pumping system 50 to dispense the required amount of syrup according to the selected syrup as described herein above.

It will be further appreciated that the order and timing of the dispensing of both syrup and carbonated water into cup 95 may also be coordinated by controller 10 based on pre-defined schedules held in database 20, to ensure the optimal mixing for the desired drink and to minimize excess frothing caused by the syrup being mixed with the carbonated water.

Figure 6:
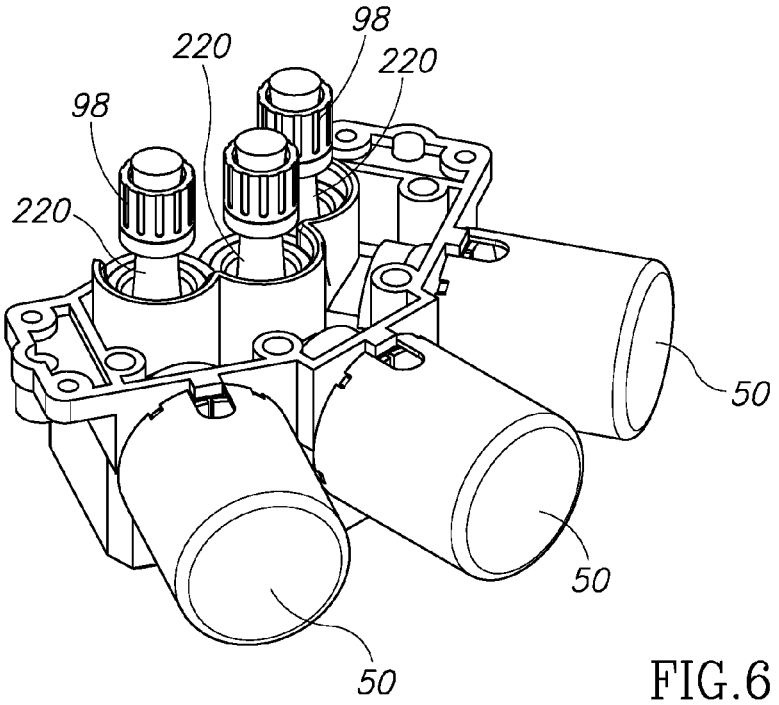
FIG. 6 is a schematic illustration of multiple dispensing tubes of FIG. 3 positioned within an associated syrup pumping system; constructed and operative in accordance with the present invention.
Figure 7:
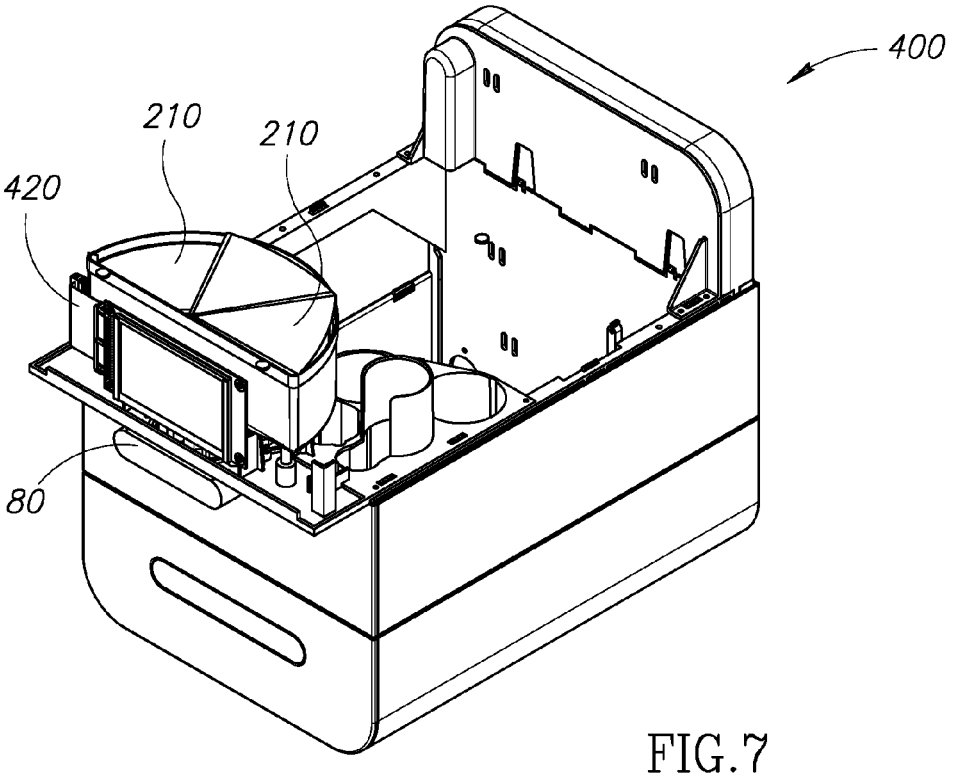
FIG. 7 is a schematic illustration of a syrup bag holder within a drink dispensing machine; constructed and operative in accordance with the present invention.

As discussed herein above, each syrup bag 210 may be associated with its own individual pumping system 50 and dispensing tube 220 as is illustrated in FIG. 6 to which reference is now made. FIG. 6 shows three dispensing tubes 220 which are attached to three different syrup bags 210 (not shown) via threaded spouts 98. As can be seen, each dispensing tube 220 may be positioned within an associated pumping system 50. The pertinent pumping system is the then activated according the choice of drink as described herein above. It will be appreciated that syrup bag 210 may be shaped to fit into a syrup holder 420 which may be part of a home carbonated drink dispensing machine 400 as is illustrated in FIG. 7 to which reference is now made. FIG. 7 illustrates a home carbonated drink dispensing machine 400 built with a syrup holder 420 designed to hold three different syrup bags 210. In an alternative embodiment, syrup holder 420 may be designed to hold more or less than three syrup bags 210. As discussed herein above, each syrup bag 210 may comprise an opening 63 from which syrup may be dispensed. It will be appreciated that when not in use, opening 63 may be sealed with a suitable threaded lid.

Referring back to FIG. 3, each syrup bag 210 may be associated with a dispensing tube 220 which may be connected to opening 63 via threaded spout 98. It will be further appreciated that since syrup may only be dispensed via tube 220 when pumping system 70 is engaged, no syrup may drip unnecessarily from tube 220 ensuring a clean environment within drink dispensing machine 400.

Applicants have realized that an issue with multiple drink dispensing machines is the problem of cross contamination. Within multiple drink dispensing machines, different drinks are typically prepared separately and dispensed from the same dispensing tube. For example, chicken soup dispensed from a tube that previously dispensed hot chocolate may not necessarily taste like chicken soup. Another issue with such multiple drink dispensing systems is hygiene. Multiple drinks may be dispensed over a prolonged period of time without the dispensing tube being changed or cleaned (if indeed it ever is).

Figure 8:
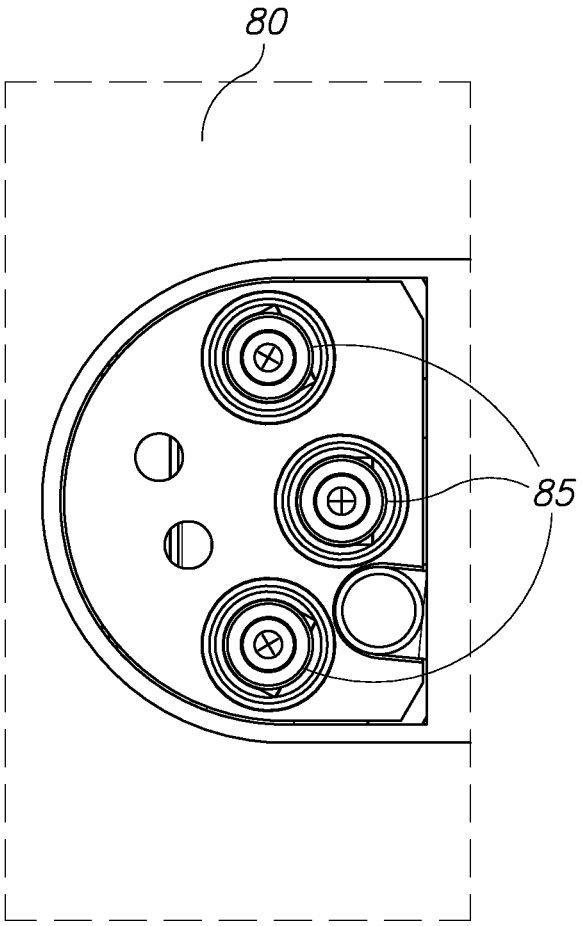
FIG. 8 is a schematic illustration of the tube holder tray of the drink dispensing machine of FIG. 7, constructed and operative in accordance with the present invention.

Therefore each flavor of syrup may be dispensed from its separate syrup bag 210, only through its associated dispensing tube 220. Reference is now made to FIG. 8 which shows a tube holder tray 80 as part of the drink dispenser 320 of dispensing machine 400. As can be seen, tube holder tray 80 may further comprise multiple holes 85. It will be appreciated that each individual hole 85 may hold either a dispensing tube 220 to dispense syrup or a dispensing tube 221 to dispense carbonated water into cup 95. It will be further appreciated that holes 85 may hold tubes 220 and tubes 221 at an angle to ensure that all dispensing pours into cup 95.

It will be appreciated that syrup bags 210 and dispensing tubes 220 and 221 may be easily removed from drink dispensing machine 400. This may allow for an easy rotation of different flavored syrups from different syrup bags 210 over the three that may be placed at any one time in drink dispensing machine 400. It will be further appreciated that if syrup bag 210 still contains syrup when it is removed, it may be sealed with a suitable threaded lid at bottom point 63 and put aside until it is next required. It will be further appreciated that controller 10 may recognize syrup bag 210 from a previous use via RFID reader/writer 30, may track the amount of syrup that has been dispensed and may therefore know the amount that remains. In an alternative embodiment, RFID tag 215 may be read/write capable and controller 10 may write the amount left in syrup bag 210 to RDID tag 215 after every use or just before syrup bag 210 is removed. In this embodiment, the same syrup bag 210 may be used by different drink dispensing machines 400, each machine 400 having the ability to recognize the amount of content in syrup bag 210.

Dispensing tubes 220 and 221 may be dishwasher safe and may be removed and washed after every use if required. It will be appreciated that once a dispensing tube 220 has been cleaned; it may be re-used with any syrup bag 210. Syrup bag 210 may be disposable and may be thrown away after use. It will be appreciated that syrup bag 210 may not be reusable since RFID tag 215 must represent the correct content information of the pertinent syrup bag 210 and may also keep record of the amount held within. As discussed herein above, controller 10 may recognize a syrup bag 210 that is replaced within system 400 via its RFID tag 215. Therefore if used syrup bag 210 is refilled with different syrup, controller 10 may recognize the syrup bag 210, know that all of its contents have already been dispensed and may therefore prevent pumping system 200 from dispensing.

In an alternative embodiment, non-carbonated drinks may also be produced. It will be appreciated that in this embodiment, controller 10 may instruct water supply 340 to provide water to dispenser 320 accordingly.

Thus a carbonated drink may be created according to the desired level of carbonation, syrup flavor and concentration in a clean, hygienic controlled environment. The use of separate dispensing tubes may ensure that cross contamination between different flavored drinks is avoided.

Unless specifically stated otherwise, as apparent from the preceding discussions, it is appreciated that, throughout the specification, discussions utilizing terms such as "processing," "computing," "calculating," "determining," or the like, refer to the action and/or processes of a computer, computing system, or similar electronic computing device that manipulates and/or transforms data represented as physical, such as electronic, quantities within the computing system's registers and/or memories into other data similarly represented as physical quantities within the computing system's memories, registers or other such information storage, transmission or display devices.

Embodiments of the present invention may include apparatus for performing the operations herein. This apparatus may be specially constructed for the desired purposes, or it may comprise a general-purpose computer selectively activated or reconfigured by a computer program stored in the computer. Such a computer program may be stored in a computer readable storage medium, such as, but not limited to, any type of disk, including floppy disks, optical disks, magnetic-optical disks, read-only memories (ROMs), compact disc read-only memories (CD-ROMs), random access memories (RAMs), electrically programmable read-only memories (EPROMs), electrically erasable and programmable read only memories (EEPROMs), magnetic or optical cards, Flash memory, or any other type of media suitable for storing electronic instructions and capable of being coupled to a computer system bus.

The processes and displays presented herein are not inherently related to any particular computer or other apparatus. Various general-purpose systems may be used with programs in accordance with the teachings herein, or it may prove convenient to construct a more specialized apparatus to perform the desired method. The desired structure for a variety of these systems will appear from the description below. In addition, embodiments of the present invention are not described with reference to any particular programming language. It will be appreciated that a variety of programming languages may be used to implement the teachings of the invention as described herein.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A dosing system comprising:

a dispensing tube to dispense a viscous liquid from a holding container to an output container, said dispensing tube comprising an upper and a lower valve; and a peristaltic pump comprising a solenoid with a bobbin coil and a rear magnet, said solenoid having a metal core integrally connected with a piston cap at a first end and a permanent magnet at a second end thereof, said permanent magnet having a magnet attraction to said rear magnet, and a hall effect sensor to measure a strength of a front sensor magnet of said pump and to determine a presence of said dispensing tube;

said piston cap to push against said dispensing tube when said bobbin coil is charged, causing said viscous liquid to open said lower valve.

2. The system according to claim 1 and also comprising an RFID reader to read information stored on an RFID tag attached to said holding container;

a database to store pre-determined schedules based on said information; and a controller to instruct said pump to pump said viscous liquid from said holding container according to said pre-determined schedules.

3. The system according to claim 2 and wherein said information is at least one of: attributes of said viscous liquid and an amount of said viscous liquid previously dispensed from said holding container.

4. The system according to claim 2 and wherein said RFID tag is at least one of: read and read/write capable.

5. The system according to claim 2 and also comprising an RFID writer to write said information onto said RFID tag.

6. The system according to claim 2 and also comprising an RFID writer to write said information onto said RFID tag.

7. The system according to claim 1 and wherein said dispensing tube comprises threads to connect to said holding container via a threaded spout.

8. A home system for producing a flavored carbonated drink, said home system comprising:

a carbonation system to carbonate water according to a desired level of carbonation;

a syrup holder to hold at least one syrup container, each syrup container to contain a syrup;

an RFID reader to read information about said syrup stored on an RFID tag attached to said at least one syrup container;

a database to store pre-determined schedules based on said information;

wherein said information is at least one of: attributes of said syrup and an amount of said syrup previously dispensed from said at least one syrup container;

a pumping system includes a peristaltic pump, one per said at least one syrup container, to pump syrup according to a pre-determined schedule, the peristaltic pump comprising a solenoid with a bobbin coil and a rear magnet, said solenoid having a metal core integrally connected with a piston cap at a first end and a permanent magnet at a second end thereof, said permanent magnet having a magnet attraction to said rear magnet, and a hall effect sensor to measure a strength of a front sensor magnet of said pump and to determine a presence of said dispensing tube;

wherein said pre-determined schedules are based on said information and a desired strength of drink;

a drink dispenser to dispense said carbonated water and said syrup into a drinking vessel; and a controller to receive said desired strength of drink and a selected syrup flavor and to coordinate between said carbonation system, said pumping system and said drink dispenser to dispense the flavored carbonated drink according to said level of carbonation and said selected syrup flavor.

9. The system according to claim 8 and also comprising:

a syrup dispensing tube, one per said at least one syrup container, attached to said at least one syrup container via a threaded spout to dispense said syrup into said drinking vessel, said syrup dispensing tube having an upper and a lower valve; and a water dispensing tube to dispense at least one of carbonated water and non-carbonated water into said drinking vessel.

10. The system according to claim 9 and wherein said pumping system comprises:

the peristaltic pump to push against said syrup dispensing tube and to cause said viscous liquid to open said lower valve.

11. The system according to claim 10 and wherein said peristaltic pump comprises:

said piston cap to push against said dispensing tube when said bobbin coil is charged causing said syrup to open said lower valve.

12. The system according to claim 9 and wherein said drink dispenser comprises a tube tray holder having multiple holes to position a plurality of said syrup dispensing tubes and said water dispensing tube to ensure direct dispensing into said drinking vessel.

13. The system according to claim 8 and wherein said RFID tag is at least one of read and read/write capable.

* * * * *